US008182314B2

(12) United States Patent
Goerges

(10) Patent No.: US 8,182,314 B2
(45) Date of Patent: May 22, 2012

(54) AUTOMATED EDGED LENS DEBLOCKING SYSTEM

(76) Inventor: James Gregory Goerges, East Gull Lake, MN (US)

( * ) Notice: Subject to any disclaimer, the term of this patent is extended or adjusted under 35 U.S.C. 154(b) by 830 days.

(21) Appl. No.: 12/291,424

(22) Filed: Nov. 8, 2008

(65) Prior Publication Data

US 2010/0115752 A1 May 13, 2010

(51) Int. Cl.
*B24B 1/00* (2006.01)
*B23P 19/04* (2006.01)

(52) U.S. Cl. ..... 451/54; 29/426.5

(58) Field of Classification Search ..... 29/426.5, 29/252, 267, 244; 451/54, 390, 41–45
See application file for complete search history.

(56) References Cited

U.S. PATENT DOCUMENTS 3,962,833 A 6/1976 Johnson
7,749,051 B2 * 7/2010 Zaiser ..... 451/41

* cited by examiner

*Primary Examiner* — John C Hong
(74) *Attorney, Agent, or Firm* — David George Johnson

(57) ABSTRACT

A lens deblocking system (1) used for removing a lens (51) from an edging block (22). The system (1) includes opposed movable arms (4, 5) that are constrained to travel longitudinally within an aperture (3) so as to grip a lens (51) that is adhesively secured to an edging block by a pad (52). The edging block (22) is held within a clamp (11) that resides on a collet closer (63) which may be rotated by activating an air cylinder (82). A cam push block (91) is linked to file cylinder (82) as well as a cam arm (98) that is attached to a spindle (96) extending from the collet closer (63). In response to the movement of the push block (91) a rotational motion is imparted to the clamp (11) via the cam arm (98). The rotation of the clamp (11) occurs while the lens (51) is still constrained against rotational movement between the movable arms (4, 5) thereby physically breaking the bond between the pad (52) and the clamp (11) and permitting subsequent manual removal of the pad (52) from the lens (51).

13 Claims, 12 Drawing Sheets

AUTOMATED EDGED LENS DEBLOCKING SYSTEM

BACKGROUND OF THE INVENTION

1. Field of Invention

This invention pertains generally to the field of lens fabrication and more particularly to the removal of a lens from a lens retaining block.

2. Description of Prior Art

The fabrication of lenses includes processing steps to generate both the surfaces of the lenses so as to impart specific optical properties to the lens, and also to accomplish the peripheral alteration, or edging, of the lenses. The first step in altering a lens is typically the generation of a surface on a partially finished lens blank. The second step in processing the lens is normally the peripheral alteration of the shape of the surfaced lens. The lens blanks and surfaced lenses may be, for example, spherical, cylindrical, optical flats, aspherical, or of multiple focal lengths. Once the lenses have been finished they may be put to a variety of uses such as spectacle lenses, camera lenses, or lenses used in instrumentation.

Edging the lens to obtain a desired shape involves a series of steps. Typically the optical center and, optionally the cylinder axis, of the lens is located and marked on a face. In those instances when the lens to be edged contains an asymmetric surface it is necessary that the optical center and cylinder axis of the lens be located and marked. Next, the lens is attached to a lens block by some type of holding mechanism, such as an adhesive, so that the optical center, and optionally the cylinder axis, of the lens are aligned with the center point and cylinder axis of the block. The desired peripheral shape is then imparted to the lens. During edging the temperature of the lens rises. The lens is often exposed to the steady flow of a coolant in order to prevent the lens from cracking.

Some means must be provided to attach the lens blank to the edging block with a bond that will not fail during alteration yet is possible to break once alteration is complete. In practice, the lens may be removed from the block by a variety of methods. For example, the lens may be pried from the block. However, this method has the disadvantage that the lens is often chipped, scratched, or otherwise damaged by the act of prying. This method can be facilitated by immersing the lens and block in hot water for a short period of time. However, some plastic lens materials cannot withstand such temperatures.

Another method of lens removal is the use of a fluid that is forced against the surface of a blocking pad that is adhered to the lens, thereby reducing the force holding the pad to the lens or block. Approximately two atmospheres of fluid gauge pressure are sufficient to reduce the holding force such that the lens may be easily separated from the block. The fluid used to achieve removal should comprise a gas or liquid that is nontoxic and which will be inert with respect to the lens block, the blocking pad, and the lens. Representative examples of useful gases for pneumatic lens removal include air, nitrogen, carbon dioxide, helium, and fluorocarbon gases. Representative examples of useful liquids for hydraulic lens removal include water, hydraulic oils, mineral oils and fluorocarbon liquids.

Another method of lens removal employs a tab that is pulled in the direction of the plane of the blocking pad so as to cause a reduction in the thickness of the pad and a progressive disengagement of the pad from the interface between lens and block. Removal may also be accomplished by placing the combination of lens, blocking pad and block into a cavity of the mounting block and then rotating the lens and the block in opposite directions with respect to each other, thereby causing them to separate. A specially designed hand tool may also be provided to accomplish this same result. The tool is not as wide as the mounting block and facilitates removal by making it easier to grasp the edge of the lens.

The latter method of lens removal is disclosed in U.S. Pat. No. 3,962,833 entitled METHOD FOR THE ALTERATION OF A LENS AND AN ADHESIVE LENS BLOCKING PAD USED THEREIN, issued to Johnson on Jun. 15, 1976: The problem repeatedly grasp pliers or a similar tool to remove the lens. Some level of skill is required to perform the lens removal operation rapidly while avoiding damage to the lens. After a period of time in such an occupation, the operator is likely to suffer various forms of fatigue and injury including, for example, carpal tunnel syndrome.

A final issue to be faced when removing a lens from an edging block is the relatively recent development and use of hydrophobic and oleo phobic coatings, which cause the surface of coated lens to have a relatively low coefficient of friction. The relatively slick frictionless lens surface required the development of adhesive pads having relatively greater adhesion which caused the aforementioned methods of lens removal to be generally less effective. In particular, the conventional methods of lens deblocking resulted in crazing, pitting or other scarring and damage to the lens, or additional treatment step to remove adhesive residue from the lens.

SUMMARY OF THE INVENTION

The current invention is an improved apparatus and method for the removal of a lens from an edging block. The present invention retains the blocked lens by means of a collet chuck or clamp. The blocked lens resides on a pad which supports the lens on the edging block while protecting the lens from abrasion or damage from the block itself. A pair of opposed slidable lens clamps or arms are pneumatically advanced to grip the blocked lens along portions of the lens edge. Once the lens is secured by the lens clamp, the collet chuck is rotated approximately forty five degrees, thereby breaking the bond between the lens and the edging block. The lens clamps may then be retracted away from the lens edges and the lens may be manually removed from the pad.

The surface area of the combined edging block and pad is typically on the order of fifty percent of the total lens surface area. Thus when the lens is freed from the pad by the twisting motion of the collet, the lens is still sufficiently supported by the pad, which itself still rests on the edging block, to prevent the lens from falling off of the pedestal formed by the collet. After the lens is removed, the pad may be lifted from the edging block and then the edging block may be removed from the collet.

In a preferred embodiment of the invention, the device includes a pair of collet chucks or clamps spaced apart along a line that is substantially parallel to a line formed by the gripping edges of the lens clamps. In this embodiment, a blocked lens is placed on each collet and both lenses are gripped simultaneously by the opposed jaws of the lens clamps. The collets are rotated simultaneously by means of a manually operated switch, thereby freeing each lens from its respective pad. When the lens clamps are retracted, each lens may be easily lifted from its respective pad. These and other advantages of the present invention will become apparent by referring to the accompanying drawings and the detailed description of the invention.

DETAILED DESCRIPTION OF THE PREFERRED EMBODIMENTS

Figure 1:
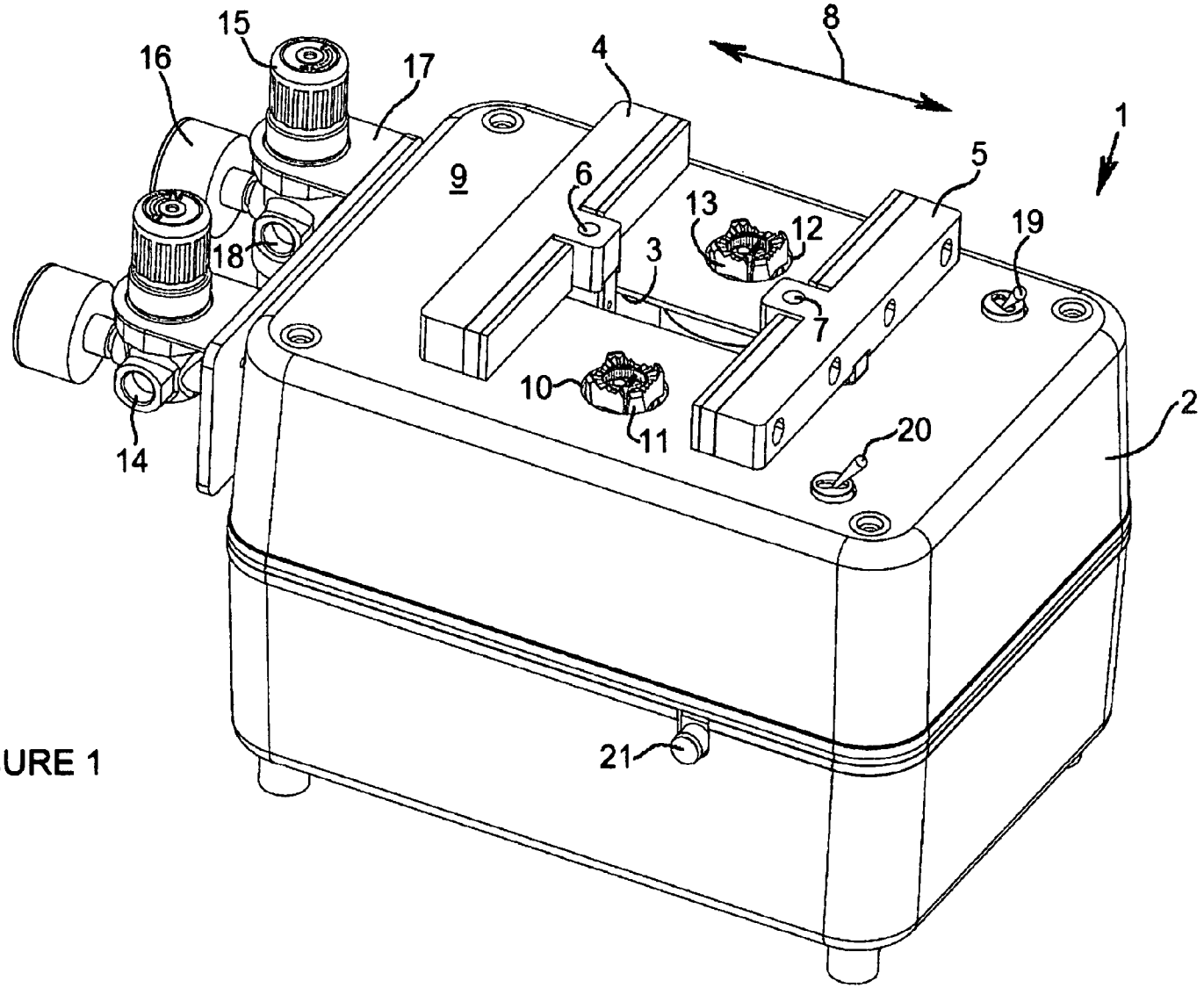
FIG. 1 is a perspective view of an automated edged lens deblocking system constructed according to the principles of the present invention.

Referring to FIG. 1, an automated edged lens deblocking system constructed according to the principles of the present invention is shown generally at 1. The deblocking system 1 includes a protective cabinet 2 typically composed of a durable metal or plastic material. The top surface 9 of the cabinet 2 is formed to include a generally rectangular aperture or slot 3 above which a pair of opposed arms 4 and 5 are slidably mounted by means of supports 6 and 7. The supports 6 and 7 permit movement of the arms 4 and 5 in the directions generally indicated by arrow 8. The top surface 9 also includes an opening or first circular aperture 10 which permits access to a first edging block clamp 11. A second circular aperture 12 is located in a symmetrical position opposite the rectangular aperture 3. The circular aperture 12 permits access to a second collet or edging block clamp 13.

Figure 2:
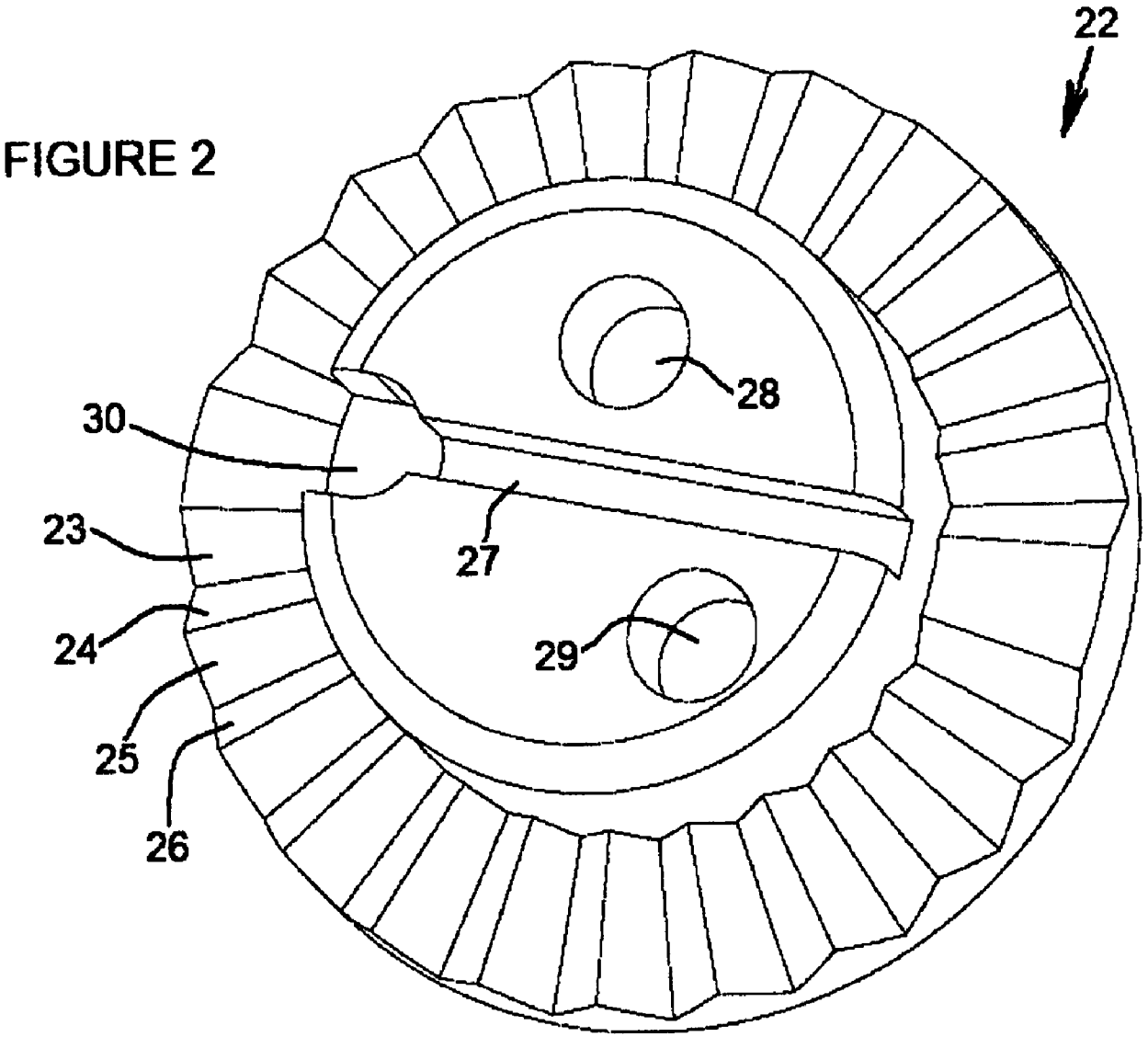
FIG. 2 is a perspective view of one of the many various types of edging block that may be utilized by the system depicted in FIG. 1.
Figure 8:
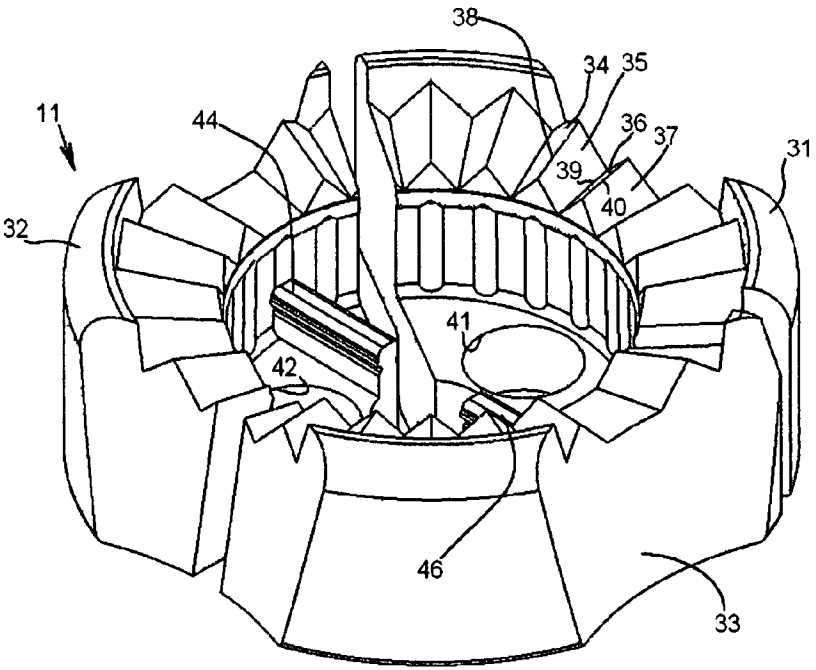
FIG. 8 is a perspective view of the collet depicted in FIG. 1.
Figure 9:
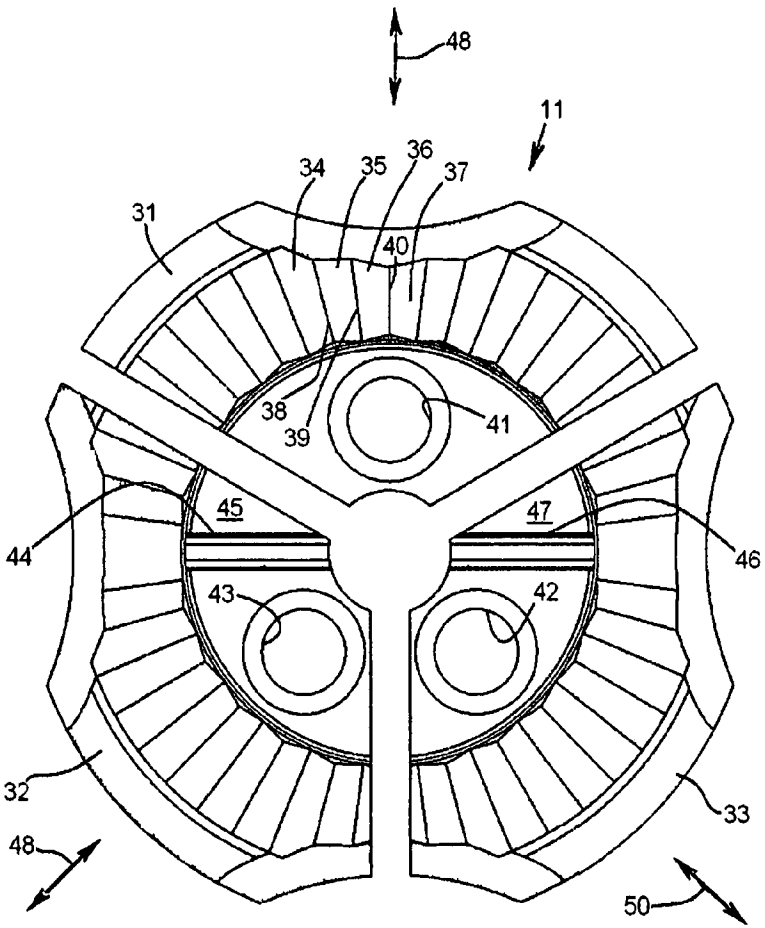
FIG. 9 is a top plan view of the collet illustrated in FIG. 1.

As best seen in FIGS. 8 and 9, each edging block clamp, such as first edging block clamp 11, includes three distinct, separable regions or jaws 31, 32 and 33. Each region includes a series of inclined, angular and substantially planar surfaces, such as surfaces 34, 35, 36 and 37, with each surface joining adjacent surfaces along a line, such as lines 38, 39 and 40. Each region 31-33 also includes a substantially circular aperture or bore, such as bores 41, 42 and 43, for example. A ridge 44 extends across the floor 45 of jaw 32, while a collinear ridge 46 extends along the floor 47 of jaw 33. Each of the features of the edging block clamp 11 facilitates the ability of the clamp to mate with or grip an edging block 22 as depicted in FIG. 2. Additionally, the edging block clamp 11 is textured with a Carbinite high friction coating to facilitate gripping of the edging block 22 by the clamp 11. The Carbinite coating is available from Carbinite Metal Coatings, 508 Pittsburgh Road, Butler, Pa. 16002.

In a preferred embodiment the system 1 is pneumatically powered with air being introduced at inlet 14 of regulator assembly 17, which also includes a regulating valve 15, an air filter 18 and an air pressure indicator 16. Several controls are accessible to the operator of the system 1, including a first toggle switch 19 that causes the edging block clamps 11 and 13 to grip or release an edging block that may be placed upon them by moving jaws 31-33 in the directions indicated by the arrows 48, 49 and 50, respectively.

As seen in FIG. 2, the edging block 22 includes a series of inclined surfaces, such as surfaces 23, 24, 25 and 26, for example. Additionally the block 22 includes a diametric groove 27 which broadens to a keyway 30 at one end. The block 22 also contains a pair of substantially circular indentations 28 and 29. At least some of the features such as the surfaces 23-26, the groove 27, the keyway 30, the indentation 28 and indentation 29 are adapted to mate with and be gripped either by or within an edging block clamp, such as clamp 11, when the block 22 is placed on the clamp 11 and toggle switch 19 is activated. In particular, the groove 27 is adapted to fit within and be retained by the ridges 44 and 46. The operator of system 1 also has access to a second toggle switch 20 that causes the opposed arms 4 and 5 to move in one of the directions indicated by arrow 8. A button 21 causes the edging block clamps 11 and 13 to rotate about a longitudinal axis.

Figure 3:
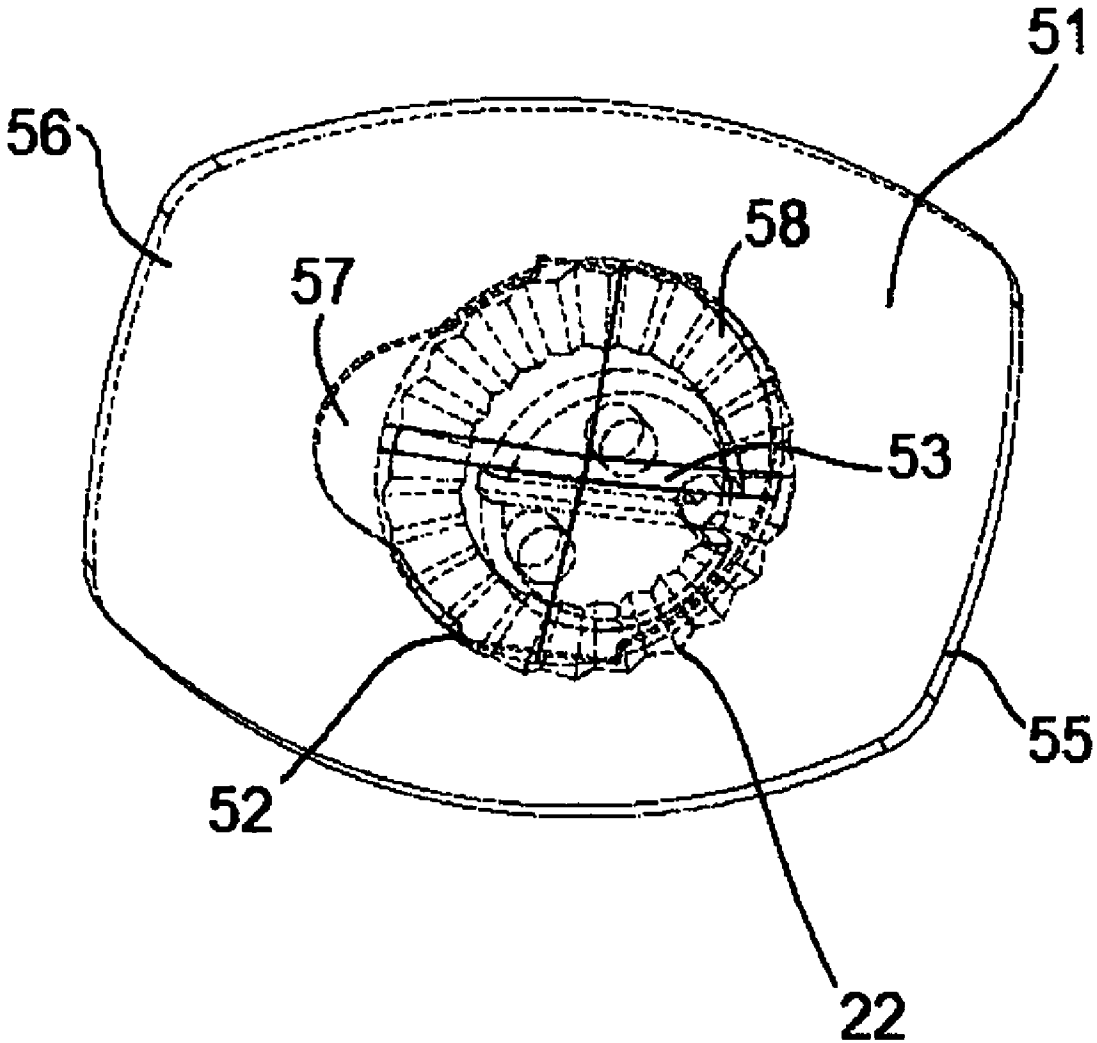
FIG. 3 is a first perspective view of an edging block and pad mounted on a lens as utilized by the system depicted in FIG. 2.
Figure 4:
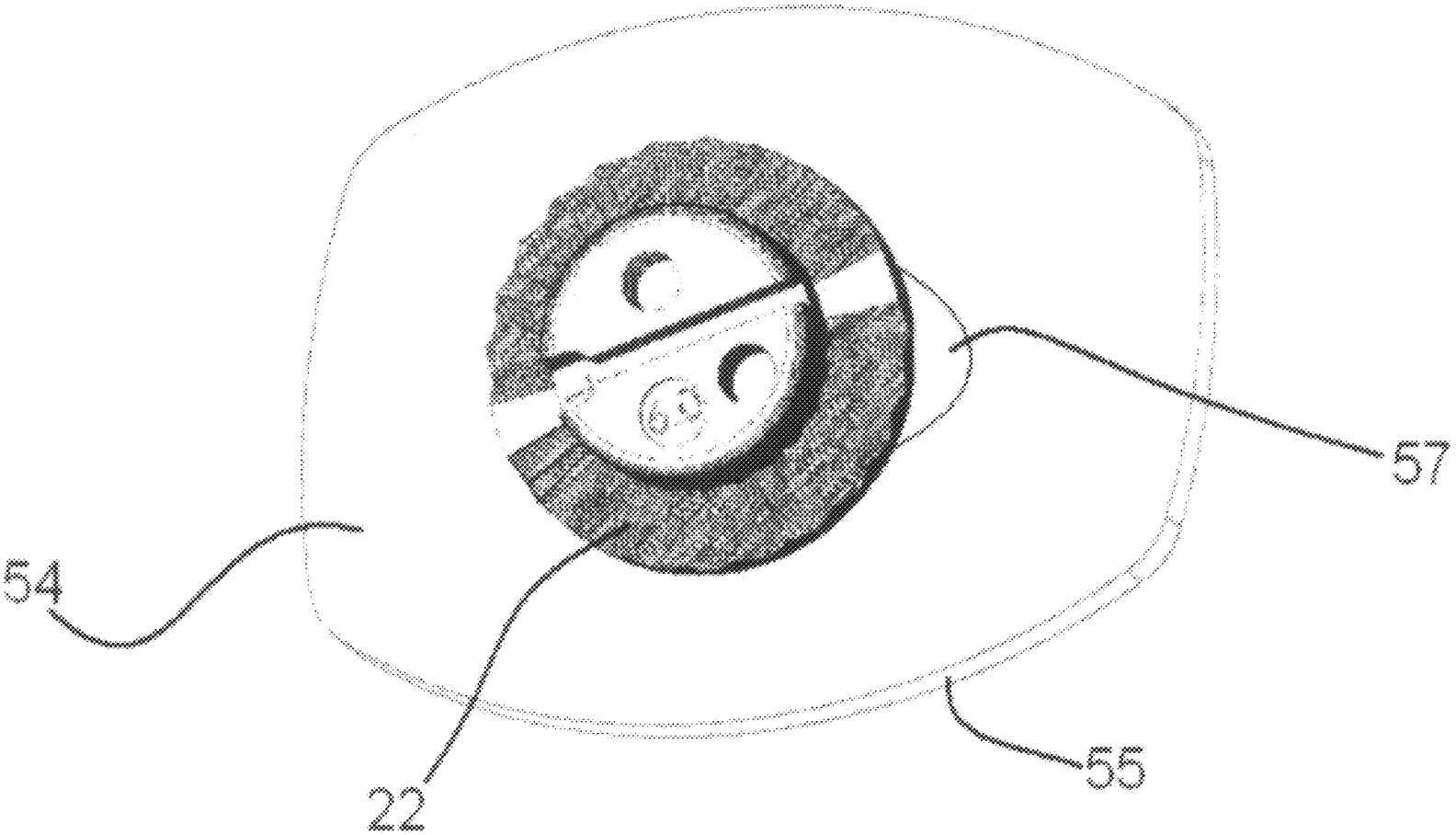
FIG. 4 is a second perspective view of an edging block and pad mounted on a lens as utilized by the system depicted in FIG. 1.

Referring also to FIGS. 3 and 4, the adherence and securing of a lens 51 to the block 22 can be better appreciated. An adhesive pad 52, having an adhesive material on each side, is affixed to the undersurface 53 of the block 22. The bottom surface 58 of the adhesive pad 52 is affixed to the bottom side 54 of the lens 51. The pad 52 includes a tab 57 which aids an operator in manually affixing and removing the pad as necessary. Due to the transparent nature of the lens 51, the pad 52 and block 22 are directly visible through the lens when viewed through the top or outer lens surface 56. The entire perimeter or edge 55 of the lens 51 remains completely accessible after the pad 52 is affixed to both the lens 51 and the block 22. The pad 52 is affixed in preparation for any of numerous types of machining or treating operations to be performed on the edge 55 of the lens during manufacture. Once the machining and treatment operations are complete, the problem remains of safely removing the adhesive pad 52 from both the lens 51 and the block 22.

Figure 5:
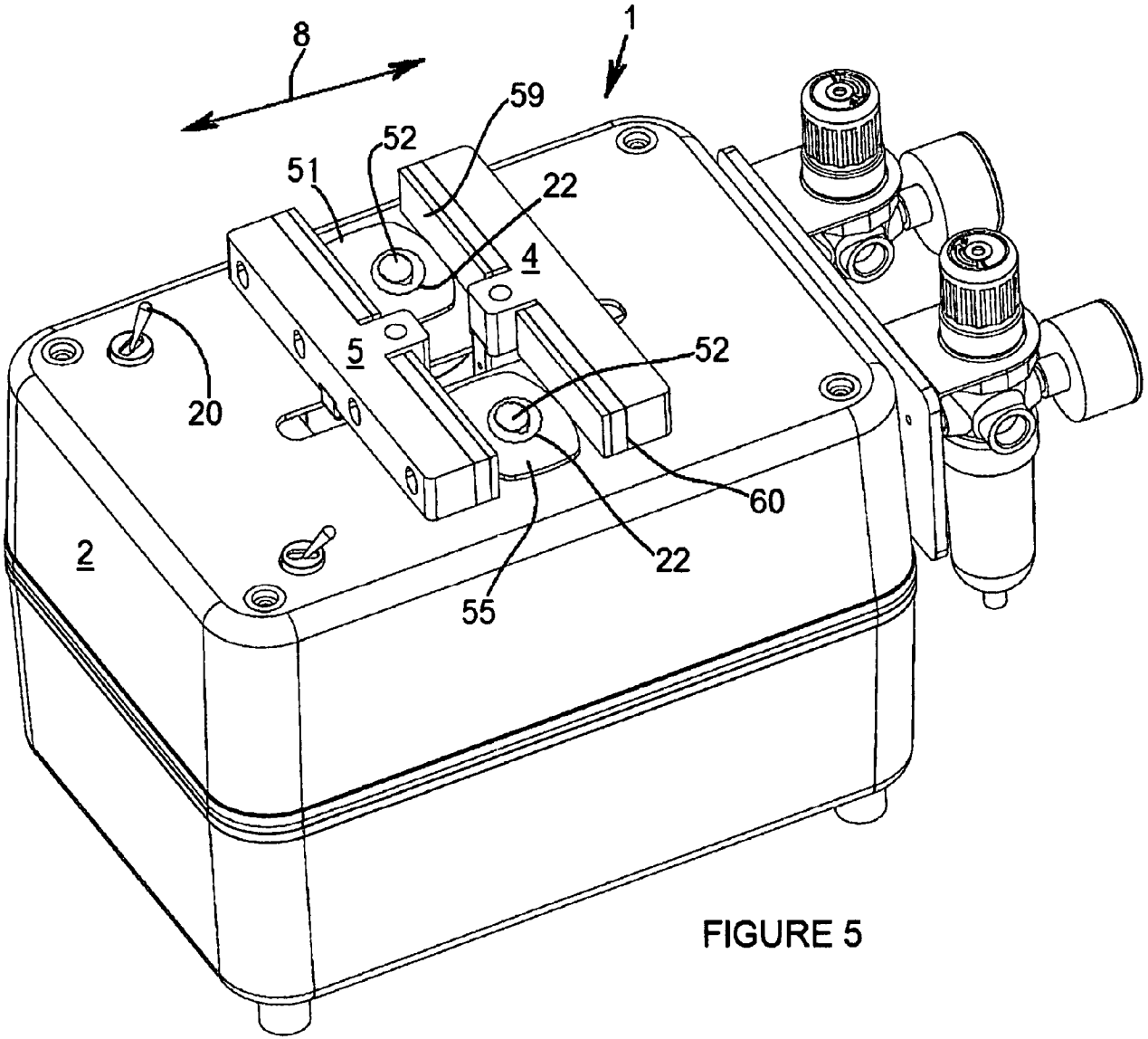
FIG. 5 is a perspective view of two lenses mounted on a pad and edging block while being retained by the deblocking system depicted in FIG. 1.

As best seen in FIG. 5, a block 22 is mounted on each of the edging block clamps 11 and 13, each block 22 supporting a pad 52. The opposed arms 4 and 5 of the deblocking system 1 are movable in the direction of arrow 8, and by actuating switch 20 the operator is able to urge both arms to simultaneously move toward the nearest edge 55 of the lens 51. A urethane cushion 59 is affixed to the inner surface 60 of each arm 4 and 5 to provided a firm grip on the lens 51 without damaging the edge 55.

Figure 6:
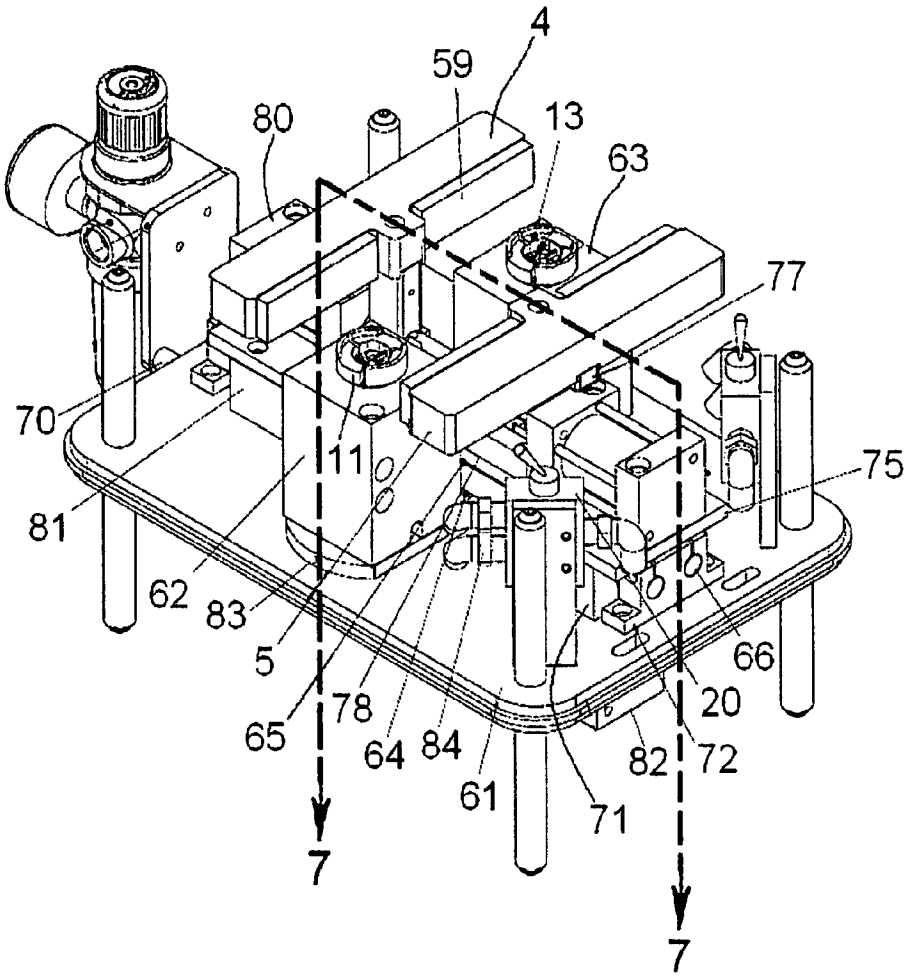
FIG. 6 is a perspective view of the automated edged lens deblocking system depicted in FIG. 1 with the chassis cover removed.
Figure 7:
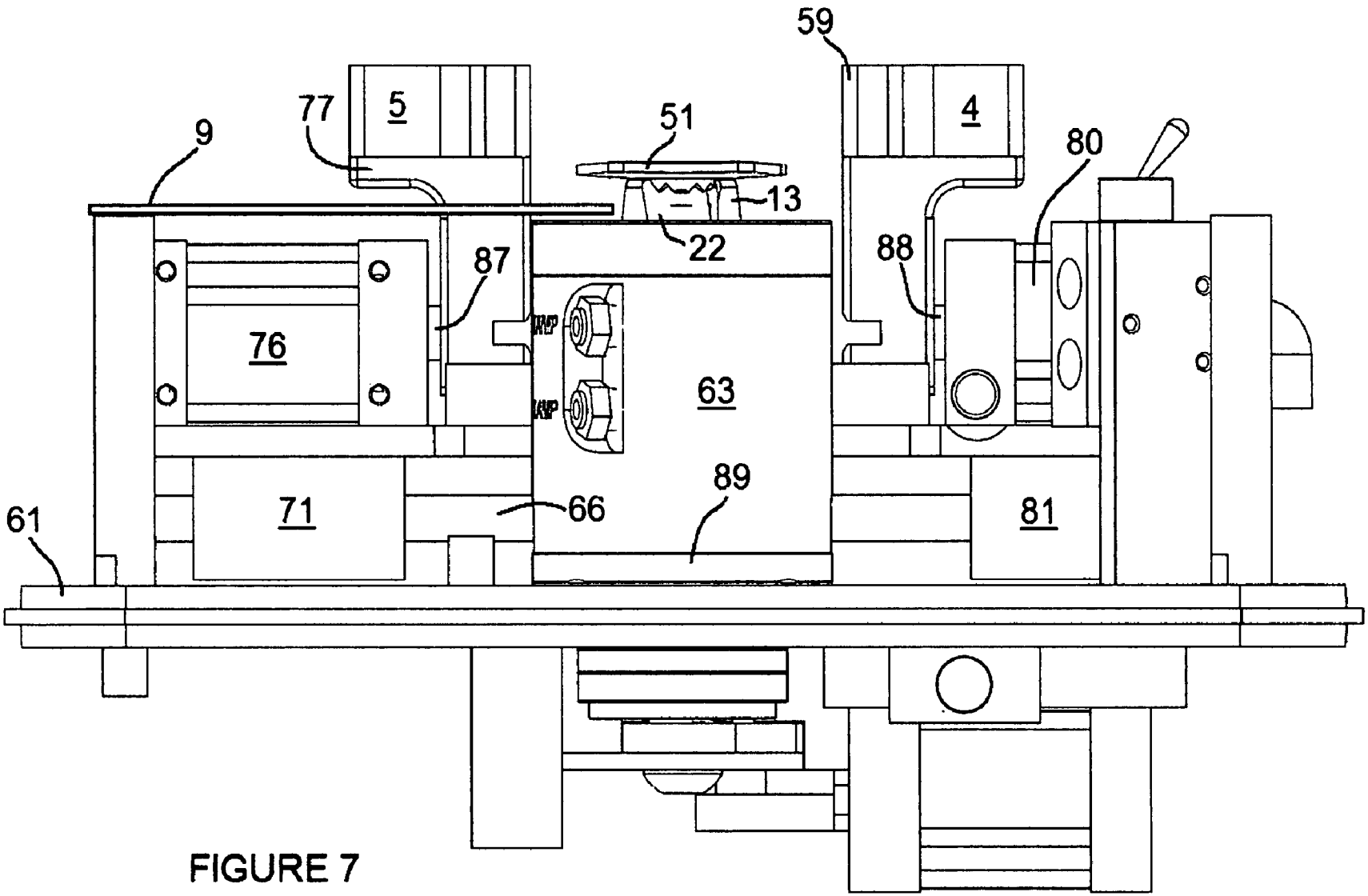
FIG. 7 is a sectional view taken along line 7-7 of FIG. 6.
Figure 10:
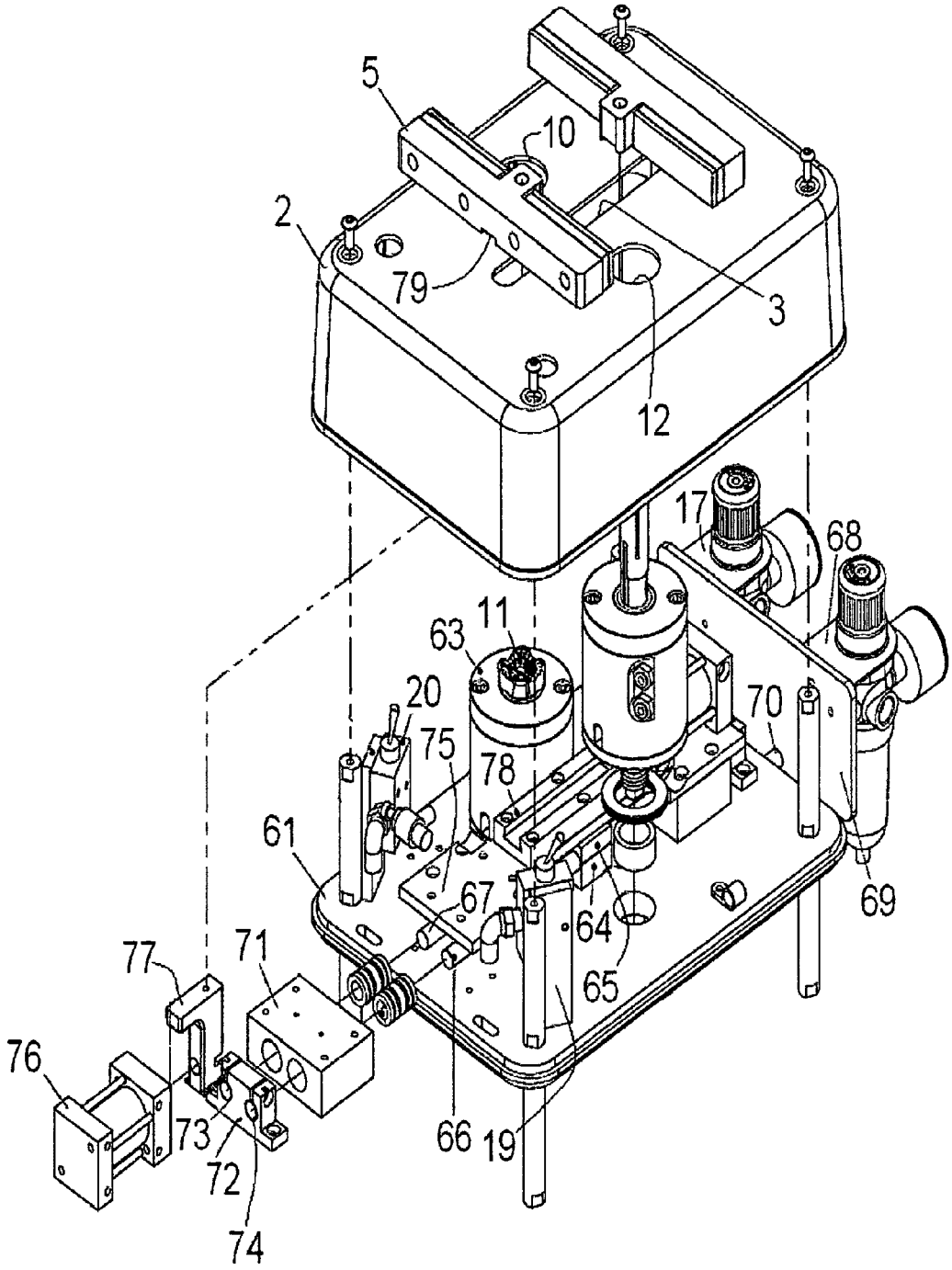
FIG. 10 is an exploded perspective view of the automated edged lens deblocking system depicted in FIG. 1.
Figure 12:
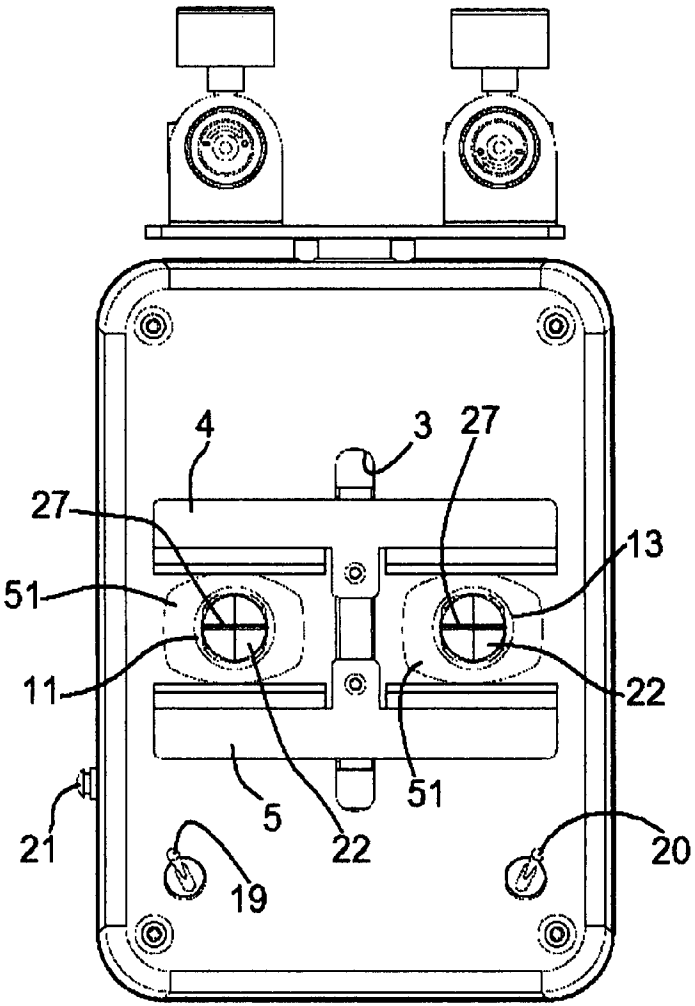
FIG. 12 is a top plan view of the automated edged lens deblocking system depicted with edging blocks and lenses mounted on the collets in a clamped position.

Referring also to FIGS. 6, 7 and 10, the internal construction and function of the system 1 may be better understood. The internal components of the system 1 are supported by a base plate 61 which may be composed of any rigid material. Mounted on the base plate 61 is a collet closer 62 which activates the first edging block clamp 11, while oppositely mounted collet closer 63 operates clamp 13. Also mounted on the base plate 61 is a support block 64 which itself supports a clamp 65, the block 64 and clamp 65 defining a path for feather shafts 66 and 67.

A pillow block 71 is affixed to a slide rail 75. Feather shafts 66 and 67 pass through a pillow block 71 and permit the assembly of the pillow block 71 and the slide rail 75 to move longitudinally along the feather shafts 66 and 67. A shaft end support block 72 is mounted so as to serve as a stop for the pillow block 71 and includes shaft passageways 73 and 74. Mounted on the slide rail 75 is an air cylinder 76 which receives pressurized air, via toggle valves 19 and 20, from the pressure regulator assemblies 17 and 68 affixed to the base plate 61 by means of a regulator mounting plate 69 which is also supported by standoff 70. The air cylinder 76 is linked to an arm pusher 77, the arm pusher being affixed to the arm 5 along indentation 79. A guide rail 78 constrains movement of the arm pusher 77 along a line that is parallel to the shafts 66 and 67 as well as the rectangular aperture 3, thereby causing the arm 5 to be urged longitudinally along a line defined by the path of the guide rail 78 whenever the air cylinder 76 is energized.

In a preferred embodiment the air cylinder or pneumatic piston 76 is a Bimba FS-091.25 air cylinder including a rod 87 having a 1.25 inch stroke length and which is marketed by the Bimba Manufacturing Company located in Monee, Ill. A second air cylinder 80 is mounted on a second pillow block 81, the second pillow block 81 also being slidably mounted on shafts 66 and 67. The second air cylinder 80 including rod 86 is coupled to the arm 4 such that operation of the first toggle valve 19 causes each air cylinder 76 and 80 to simultaneously advance the arms 4 and 5, respectively, toward the opposing arm and thereby grip the lens 51 between the opposed arms 4 and 5. The cylinders 76 and 80 exert substantially horizontal and substantially equal forces, with variations in the amount of individual force extended by each individual cylinder being balanced mote precisely by the independent motion of each cylinder 76 and 80 which are slidably mounted on the pillow blocks 71 and 81 respectively. The pressurized air used to operate the air cylinders 76 and 80 enters the toggle valve 19 via connection 84, the actual air hoses employed being omitted from the figures for the sake of clarity.

Figure 15:
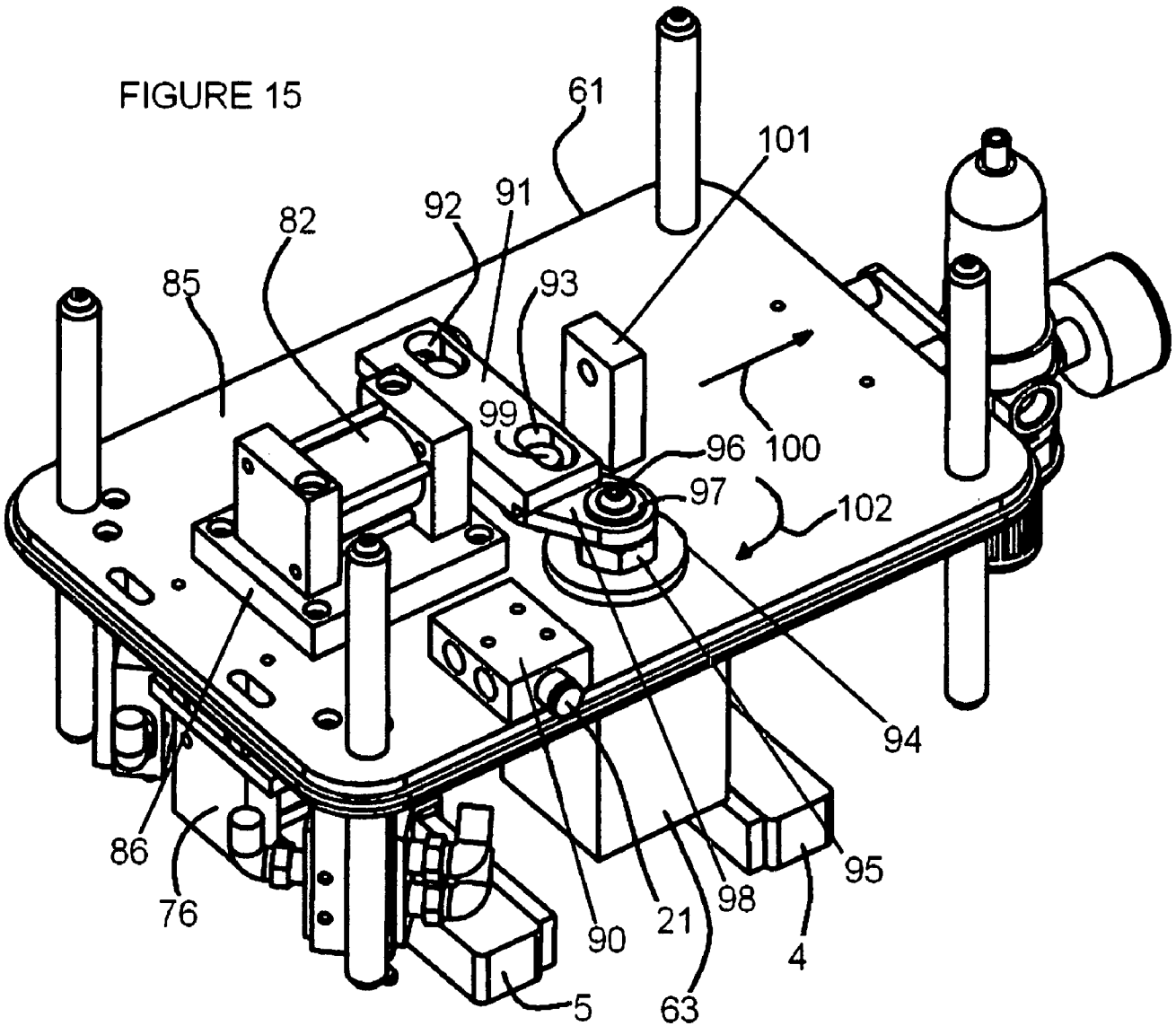
FIG. 15 is a bottom perspective view of the automated edged lens deblocking system depicted in FIG. 6 with some components removed for clarity.

Once the lens 51 is firmly secured between the arms 4 and 5, an additional air cylinder 82 is employed to impart a twisting motion to the edging block clamps 11 and 13. In a preferred embodiment, the edging block clamps 11 and 13 are mounted on rotary bases 83 and 89, respectively. As best seen in FIG. 15, the additional air cylinder 82 is mounted on the bottom surface 85 of the base plate 61 by means of a riser 86. The button 21 is connected to an air valve 90 which is in fluid communication with the additional air cylinder 82, the actual interconnecting hoses being omitted for clarity. The air cylinder 82 is connected to a cam push block 91 which is formed to include two orifices 92 and 93. Each orifice is associated with an individual collet closer, with only the collet closer 63 being shown for the sake of clarity.

The collet closer 63 is rotatably secured to the base plate 61 by means of a bearing washer 94 and a shim 95, both of which surround a spindle 96. A cam arm 98 is rigidly secured around the spindle 96 between the shim 95 and a cap 97. Extending from an end region of the cam arm is a shaft 99 that is rotatably retained within the orifice 93. Activating the push button 21 causes the cam push block 91 to advance in the direction of arrow 100 until the block 91 is pre vented from further motion in the direction of arrow 100 by the presence of the stop block 101. The motion of the cam push block 91 causes shaft 99 to also move in the direction of arrow 100 and thereby cause the collet closer 63 to rotate generally in the direction of arrow 102.

Figure 11:
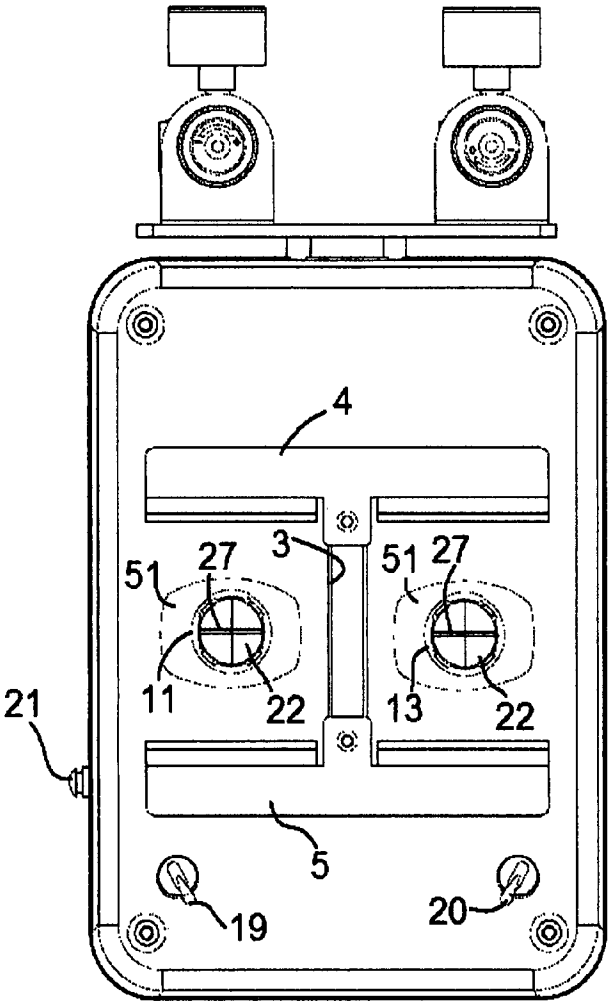
FIG. 11 is a top plan view of the automated edged lens deblocking system depicted with edging blocks and lenses mounted on the collets in an unclamped position.

Referring also to FIGS. 11, 12, 13 and 14, the operation of the system 1 can be better understood. FIG. 11 depicts the system 1 in an initial position when the lenses 51, having been previously processed while secured to the edging blocks 22, are placed onto the block clamps 11 and 13. The toggle switch 20 is then moved from the first position shown in FIG. 11 to the second position shown in FIG. 12, the switch 20 causing the block clamps 11 and 13 to security grip the edging blocks 22. The toggle switch 19 is then moved from the position shown in FIG. 11 to the position shown in FIG. 12, thereby causing the arms 4 and 5 to move toward the opposing arm as well as the nearest edge of the nearest lens 51. The arms 4 and 5 self center, that is, stop at a location which causes the lens 51 to be securely gripped regardless of the exact shape and position of each lens 51, because each arm 4 and 5 is moved into position by the action of the air cylinders 80 and 76, respectively, which are free to travel with their respective pillow blocks 81 and 71, respectively, until the force exerted by each cylinder 60 and 76 on the arms 4 and 5 is substantially equal, regardless of the specific position of each cylinder.

Figure 14:
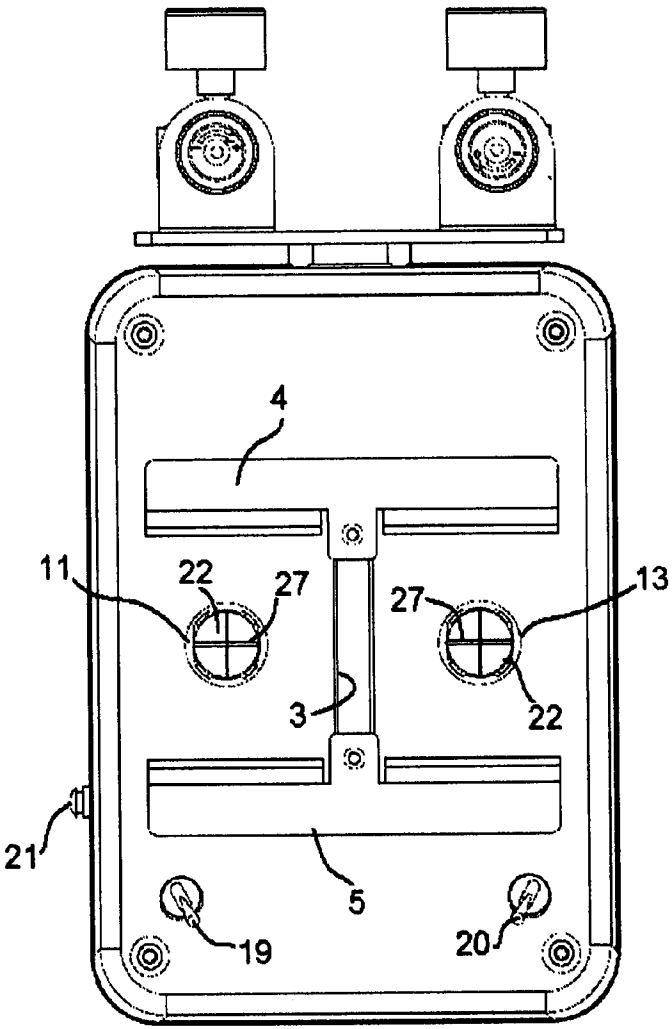
FIG. 14 is a top plan view of the automated edged lens deblocking system depicted with edging blocks mounted on the collets after the lenses have been removed.
Figure 13:
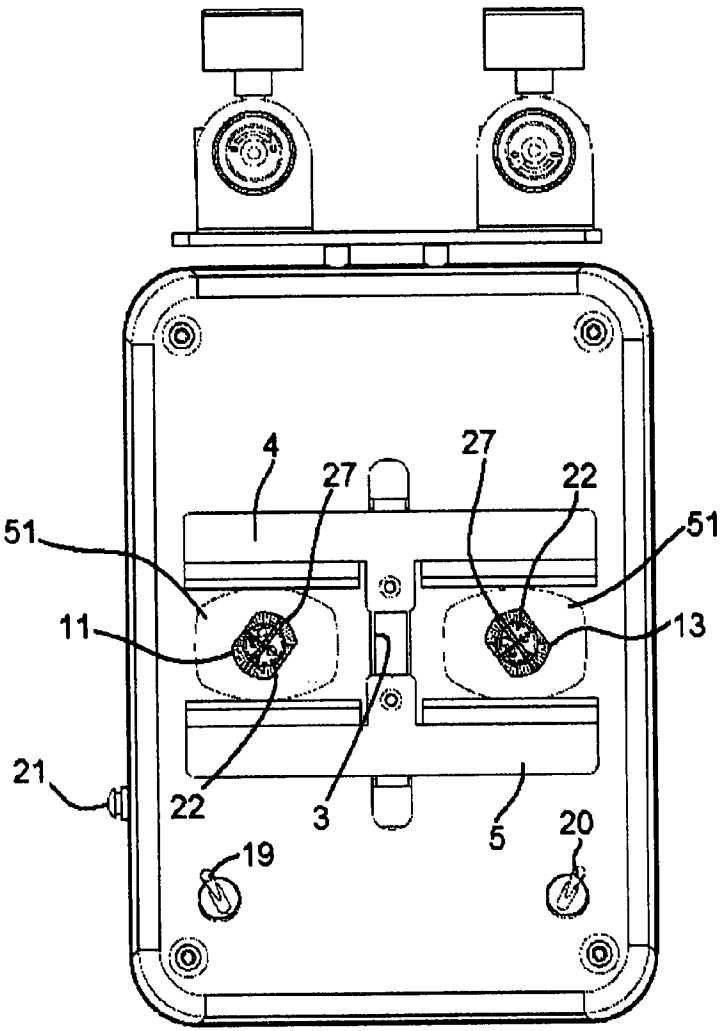
FIG. 13 is a top plan view of the automated edged lens deblocking system depicted with edging blocks and lenses mounted on the collets after the collets have been rotated from a first position to a second position.

The push button 21 is then pressed causing the cam push block 91 to impart rotation to the block clamps 11 and 13, thereby creating the geometry depicted in FIG. 13. The groove 27 can be seen to have rotated through an approximately forty five degree angle. The effect of this rotational displacement is to break the adhesive bond between the adhesive pad 52 and the lens 51 while leaving the lens 51 still securely gripped between the arms 4 and 5. FIG. 14 depicts the orientation of the groove 27 after the push button 21 has been released.

By returning the toggle switch 19 to the position shown in FIG. 14, the arms 4 and 5 will be withdrawn from the lenses 51. Since the adhesive bond between the edging blocks 22 and the adhesive pad 52 has been broken, each lens 51 can be lifted from the edging block 22 and the adhesive pad manually removed from the lens by means of the tab 57. The toggle switch 20 is then returned to the position shown in FIG. 14 in order to allow the removal of the edging blocks 22 from the block clamps 11 and 13.

The foregoing improvements embodied in the present invention are by way of example only. Those skilled in the materials processing field will appreciate that the foregoing features may be modified as appropriate for various specific applications without departing from the scope of the claims. For example, the item to be loosened due to the twisting motion of the block clamps 11 and 13 may be some device or element other than a lens 51. Further, the bond that is broken between the edging blocks 22 and die pad 52 may be some linkage other wan an adhesive, such as a mechanical, electrical or residual magnetic attraction or force.

I claim:

1. A lens deblocking system, comprising:

(a) first and second opposed movable arms, the first arm being adapted to move toward the second arm within a substantially horizontal plane and to grip a first object between the first arm and the second arm;

(b) a collet closer;

(c) a clamp, the clamp residing within the collet closer and being adapted to grip a second object, the second object being rigidly affixed to the first object;

(d) a base plate, the collet closer being rotatably affixed to the base plate such that the collet closer is capable of rotation about a substantially vertical axis; and (e) a cam arm, the cam arm being linked to the collet closer such that a substantially horizontal force acting on the cam arm causes rotation of the collet closer about a substantially vertical axis, thereby imparting a rotational force to both the first object and the second object.

2. The lens deblocking system according to claim 1, wherein the rotational force is sufficiently great so as to cause a linkage between the first object and the second object to fail.

3. The lens deblocking system according to claim 2, further comprising an adhesive pad, the adhesive pad having a first adhesive side and a second adhesive side, the first adhesive side being affixed to the first object and the second adhesive side being affixed to the second object, the adhesive pad thereby forming the linkage between the first object and the second object.

4. The lens deblocking system according to claim 3, wherein the first object is a lens, the lens further comprising:

(a) a lens edge, the first and second opposed movable arms being adapted to grip substantially opposed regions of the lens edge, (b) a first lens side, the first lens side being adapted to be affixed to the first adhesive side of the adhesive pad, and (c) a second lens side.

5. The lens deblocking system according to claim 4, wherein the second object is an edging block, the edging block further comprising:

(a) a first edging block side, the first edging block side being adapted to mate with and be securely gripped by the clamp; and (b) a second edging block side, the second edging block side being adapted to be affixed to the second adhesive side of the adhesive pad.

6. A lens deblocking system according to claim 5, wherein the adhesive pad further comprises a tab, the tab permitting manual removal of the adhesive pad from the first lens side.

7. The lens deblocking system of claim 6, further comprising:

(a) a first pneumatic piston, the first pneumatic piston being linked to the first opposed movable arm; and (b) a second pneumatic piston, the second pneumatic piston being linked to the second opposed movable arm, the first and second pneumatic pistons exerting opposing, substantially horizontal and substantially equal forces on the first and second opposed movable arms, respectively.

8. The lens deblocking system of claim 7, wherein the base plate has a top side and a bottom side, the lens deblocking system further comprising a third pneumatic piston, the third pneumatic piston being mounted adjacent to the bottom side of the base plate, the third pneumatic piston being linked to the cam arm so as to permit application of a substantially horizontal force to the cam arm, thereby imparting a substantially rotational force to the collet closer.

9. The lens deblocking system of claim 8, further comprising:

(a) a first arm pusher, the first arm pusher being affixed to the first pneumatic piston and the first opposed movable arm such that a horizontal force applied by the first pneumatic piston is transferred as a substantially equal horizontal force to the first opposed movable arm; and (b) a second arm pusher, the second arm pusher being affixed to the second pneumatic piston and the second opposed movable arm such that a horizontal force applied by the second pneumatic piston is transferred as a substantially equal horizontal force to the second opposed movable arm.

10. The lens deblocking system of claim 9, further comprising a guide rail, the guide rail being mounted adjacent to the top side of the base plate, the guide rail constraining movement of the first and second arm pushers to a collinear path.

11. The lens deblocking system of claim 10, further comprising:

(a) a plurality of cam arms, each cam arm being formed to include a substantially vertical protrusion that is substantially perpendicular to a plane of motion of the cam arm; and (b) a cam plate, the cam plate being formed to include a plurality of orifices, each orifice being adapted to receive one substantially vertical protrusion extending from one cam arm, the cam plate being linked to the third pneumatic piston such that a substantially horizontal force exerted by the third pneumatic piston is transferred to each cam arm via the substantially vertical protrusion of each cam arm.

12. A lens deblocking system providing for the removal of a blocked lens from an edging block, comprising:

(a) a rigid base plate;

(b) a pair of movable, substantially opposed arms having substantially planar faces, the opposed arms being movable toward each other so as to grip a blocked lens between the substantially planar faces of the opposed arms, the opposed arms residing above the base plate;

(c) a pair of rotatable collet closers mounted in a spaced apart relationship on the rigid base plate, the rotatable collet closers residing below the pair of movable, substantially opposed arms, each rotatable collet closer being adapted to grip and support a blocked lens such that the blocked lens resides between the movable substantially opposed arms, wherein rotation of the collet closers causes a bond between the blocked lens and the edging block to fail.

13. The lens deblocking system of claim 12, further comprising a sheet like pad having a first and second side, the first and second side each being coated with an adhesive, wherein the sheet like pad resides between the blocked lens and the edging block and secures the blocked lens to the edging block.

* * * * *